US009642768B2

(12) United States Patent
Ungemach et al.

(10) Patent No.: US 9,642,768 B2
(45) Date of Patent: May 9, 2017

(54) SKIN TREATMENT DEVICE AND IMPLEMENT

(75) Inventors: Christof Ungemach, Frankfurt am Main (DE); Michael Maichel, Frankfurt am Main (DE); Ralf Klug, Eschborn (DE); Tobias Schwarz, Schmitten (DE)

(73) Assignee: Braun GmbH, Kronberg (DE)

( * ) Notice: Subject to any disclaimer, the term of this patent is extended or adjusted under 35 U.S.C. 154(b) by 838 days.

(21) Appl. No.: 13/554,412

(22) Filed: Jul. 20, 2012

(65) Prior Publication Data

US 2013/0023805 A1 Jan. 24, 2013

(30) Foreign Application Priority Data

Jul. 23, 2011 (EP) ..... 11006050

(51) Int. Cl.
*A61H 15/00* (2006.01)
*A61H 7/00* (2006.01)
(Continued)

(52) U.S. Cl.
CPC ..... *A61H 7/005* (2013.01); *A61H 23/0254* (2013.01); *A46B 13/02* (2013.01);
(Continued)

(58) Field of Classification Search
CPC ..... A61H 7/005; A61H 23/0254; A61H 2201/018; A61H 2201/1685; A46B 13/02; A46B 2200/102
(Continued)

(56) References Cited

U.S. PATENT DOCUMENTS 2,714,788 A 8/1955 Di Giovanna Tigellia
3,968,789 A * 7/1976 Simoncini ..... 601/95
(Continued)

FOREIGN PATENT DOCUMENTS

JP 2001-304089 A1 10/2001
WO WO 2009/038296 A2 3/2009
WO WO 2010/100527 A1 9/2010

OTHER PUBLICATIONS

European Search Report and Written Opinion for EP 11 00 6050, dated Nov. 8, 2011.
(Continued)

*Primary Examiner* — Quang D Thanh
(74) *Attorney, Agent, or Firm* — Ronald T. Sia; Kevin C. Johnson; Steven W. Miller

(57) ABSTRACT

The present invention concerns a skin treatment device for professional and private use. In particular the present invention concerns a skin treatment device comprising a drive unit and an attachment, the drive unit comprising an output element and a rotary support element rotating about an axis of rotation, the rotary support element comprising protrusions, the attachment comprising a skin treatment element and a chassis for the skin treatment element, the chassis comprising a multitude of recesses to cooperate with the protrusions of the rotary support element of the drive unit, wherein the chassis can be supported by the rotary support element and wherein the protrusions can be brought into an engagement position with the recesses, while the chassis is supported by the rotary support element, and the protrusions can be brought into a disengagement position with the recesses, while the chassis is supported by the rotary support element.

5 Claims, 5 Drawing Sheets

(51) Int. Cl.
*A61H 23/02* (2006.01)
*A46B 13/02* (2006.01)

(52) U.S. Cl.
CPC .. *A46B 2200/102* (2013.01); *A61H 2201/018* (2013.01); *A61H 2201/1685* (2013.01)

(58) Field of Classification Search
USPC ..... 601/17, 18, 84, 112, 114, 134, 135, 136, 601/137, 138; 15/21.1, 22.1, 23, 28; 606/131
See application file for complete search history.

(56) References Cited

U.S. PATENT DOCUMENTS

| | | | | |
|---|---|---|---|---|
| 4,027,348 | A * | 6/1977 | Flowers et al. | 15/22.1 |
| 4,203,431 | A | 5/1980 | Abura et al. | |
| 4,858,600 | A | 8/1989 | Gross et al. | |
| 6,045,559 | A * | 4/2000 | Sueyoshi | A45D 26/0028 606/131 |
| 6,569,170 | B1 | 5/2003 | Kellogg | |
| 6,902,525 | B1 | 6/2005 | Jewell | |
| 7,386,906 | B2 | 6/2008 | Roth et al. | |
| 2006/0276731 | A1 * | 12/2006 | Thiebaut et al. | 601/112 |
| 2008/0125682 | A1 | 5/2008 | Bonneyrat | |
| 2010/0222719 | A1 * | 9/2010 | Cowie et al. | 601/46 |

OTHER PUBLICATIONS

International Search Report for PCT/IB2012/053746 dated Oct. 2, 2012.

* cited by examiner

SKIN TREATMENT DEVICE AND IMPLEMENT

FIELD OF THE INVENTION

The present invention concerns a skin treatment device for professional and private use. The device is used for achieving cosmetic or well-being benefits, for example it can be used to have a massage effect or for cleansing and refreshing the skin or for applying a cosmetic composition.

BACKGROUND OF THE INVENTION

A wide variety of cosmetic moisturizing and other agents is available to meet the interest in having a clean healthy and good-looking skin and face. Relative to these offers of the cosmetic industry, the use of skin care appliances and devices is slightly more limited, but many efforts have also been made in this field.

U.S. Pat. No. 2,714,788 discloses a device for removing hair which comprises an electric motor, a holder for an abrasive pad and an abrasive pad. This device is meant to remove hairs from the skin of, for example, the legs by means of abrasion.

EP 1 429 670 A2 discloses an ultrasonic cleaner comprising a handle and a brush positioned at the proximal end off the handle. The cleaner further comprises an ultrasonic vibrator operably attached to the brush. A battery positioned within the hollow interior of the handle provides power to the ultrasonic vibrator. Ultrasonic vibration is transmitted from the vibrator through the brush and to its bristles. The cleaner can hence be used for skin cleaning.

WO 2010/100527 A1 discloses an appliance for facial care. The facial appliance comprises a tubular body and axially extending from the tubular body a so-called facial puck. This facial puck comprises a facial implement rotatable about a shaft and a sub assembly linked to the shaft. This sub assembly includes a spinner journaled for rotation about an axis extending from the tubular body. The spinner comprises opposing, radially extending, resiliently biased release fingers. These release fingers removably mount the applicator implement (e.g. the facial implement) for rotation with the spinner. The spinner is mounted to the main gear by slip bearings.

It is an objective of the present invention to provide a versatile skin treatment device. The skin treatment device should be suitable for use with one or several implements, the use should be intuitive and it should be safe. Further the skin treatment device should be protected against accidental harm from improper usage.

SUMMARY OF THE INVENTION

The present invention concerns a skin treatment device for professional and private use. In particular the present invention concerns a skin treatment device comprising a drive unit and an attachment, the drive unit comprising an output element and a rotary support element rotating about an axis of rotation, the rotary support element comprising protrusions, the attachment comprising a skin treatment element and a chassis for the skin treatment element, the chassis comprising a multitude of recesses to cooperate with the protrusions of the rotary support element of the drive unit, wherein the chassis can be supported by the rotary support element wherein the protrusions can be brought into an engagement position with the recesses, while the chassis is supported by the rotary support element, and the protrusions can be brought into a disengagement position with the recesses, while the chassis is supported by the rotary support element.

DETAILED DESCRIPTION OF THE INVENTION

Figure 1:
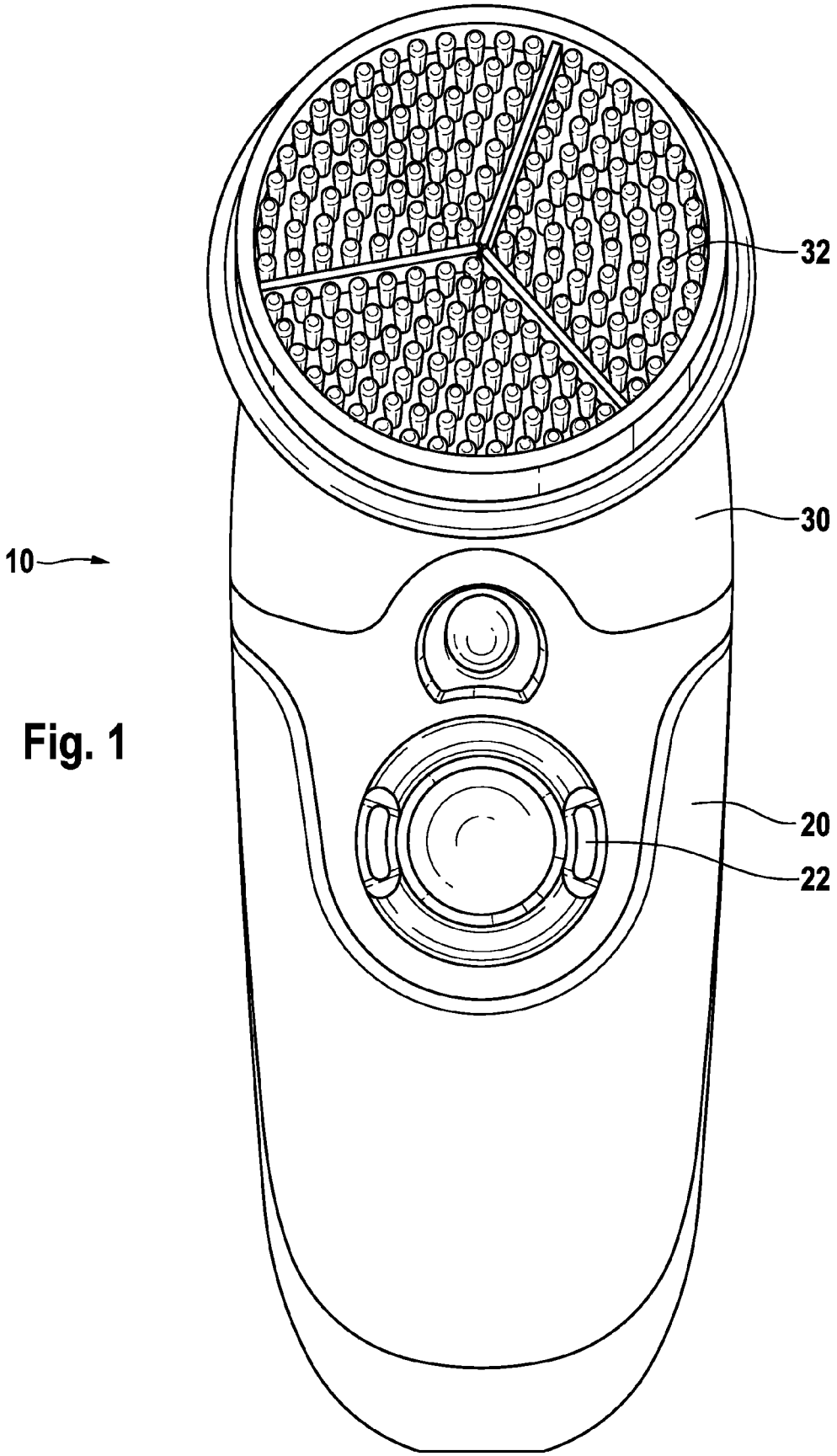
FIG. 1 shows a plain view onto a skin treatment device according to the present invention

The skin treatment device comprises a drive unit and an attachment. The skin treatment device may also be provided as a kit with two, three or more attachments. At a given time one attachment can be used with the drive unit. Additionally or alternatively, the drive unit may also be adapted to operate two or more attachments at the same time. However, a drive unit which can operate one attachment at the time has been found useful. The attachment therefore can be removably mounted to the drive unit. The drive unit can be hand operated or motor operated. Often the drive unit is operated by an electric motor. This electric motor can be operated by a battery, for example a rechargable battery. Drive units needing a cable for contact with the power supply while being operated can also be useful.

The attachment can comprise a skin treatment implement or element, for example in the form of a brush and can comprise an output element. Alternatively the output element, for example in the form of a gear box, can also be part of the drive unit. Alternatively or additionally a further gear box or a force transmission element can be comprised by the drive unit.

The attachment also comprises a rotary support element. The rotary support element can have a variety of useful forms, and should be linked to the drive unit as to impart a rotation to the skin treatment element. The rotary support element can for example have a planar surface perpendicular to the rotating axis, which can support the skin treatment element. The rotary support element further has some protrusions. The protrusions can have a variety of suitable forms, for example they can be of a rounded or a squared form, the protrusions for example can take the form of noses or pyramids or the like. Protrusions of triangular cross-sections have been found useful. The respective protrusions can be used for mechanically linking the skin treatment element to the rotary support element. For this purpose, the skin treatment element comprises a multitude of recesses. These recesses can cooperate with the protrusions of the rotary support element. To this end, it is useful that the form of the recesses is optimized for receiving the protrusions. Therefore, the recesses can also be of an essentially rounded or squared form. For example, recesses of triangular cross-section are useful for receiving protrusions of triangular cross-section. The recesses can form part of a toothed ring. It is useful, that the recesses of the rotary support element are facing towards the axis of rotation of the rotary support element.

The protrusions can be provided in the form of latches. It is useful that the protrusions are provided with spring loaded pins. The biasing force of the springs together with the form of the protrusions and recesses define the force threshold at which in response to an outer force the disengagement position is assumed. Hence, this threshold can be easily selected for a given device and the expected usage conditions.

Irrespective of the particular mechanical setup, it is desired, that the protrusions can be brought into engagement position with the recesses and, while the chassis 34 is supported by the rotary support element, into a disengagement position with the recesses.

In the engagement position a force can be transmitted to the chassis for inducing a rotational movement. The cooperation of the protrusions and recesses is such, that a low vibration and low noise operation is achieved.

In disengagement position no or essentially no such force is transmitted. Hence the chassis can move freely about the axis of rotation in the disengagement position, but continues to be supported and hence held in position by the rotary support element. Therefore, in the disengagement position, mechanical parts of the drive unit or a gear box cannot be damaged by any force exerted upon the chassis beyond the force required for the disengagement position to be assumed.

FIG. 1 shows a skin treatment device 10 with its essential elements according to the present invention. The device 10 comprises a drive unit 20. The drive unit will comprise a motor which will typically provide a rotational or vibrational movement to some output device. The motor will typically be an electrical motor which can be battery operated, preferably by a rechargable battery. The drive unit 20 will comprise a switch 22, for turning the unit on or off and/or making other selections of an operation mode.

An attachment 30 can be connected to the drive unit 20. A variety of suitable connectors are well-known, often a positive fitting is useful. Other attachments can be connected to the drive unit, for example attachment 30 can serve as a first attachment, and a further attachment can serve as a second attachment, which can also be connected to the same drive unit 20. The attachment 30 as shown comprises a brush 32. The term brush is used herein broadly, to denote an implement, which can comprise conventional bristles of a variety of materials, as known from other areas. The brush can also comprise rubber implements, which could have bristle form or which could also have the form of bars or ligaments. The brush 32 will typically have a circular outer shape, but could also have other shapes.

Figure 2:
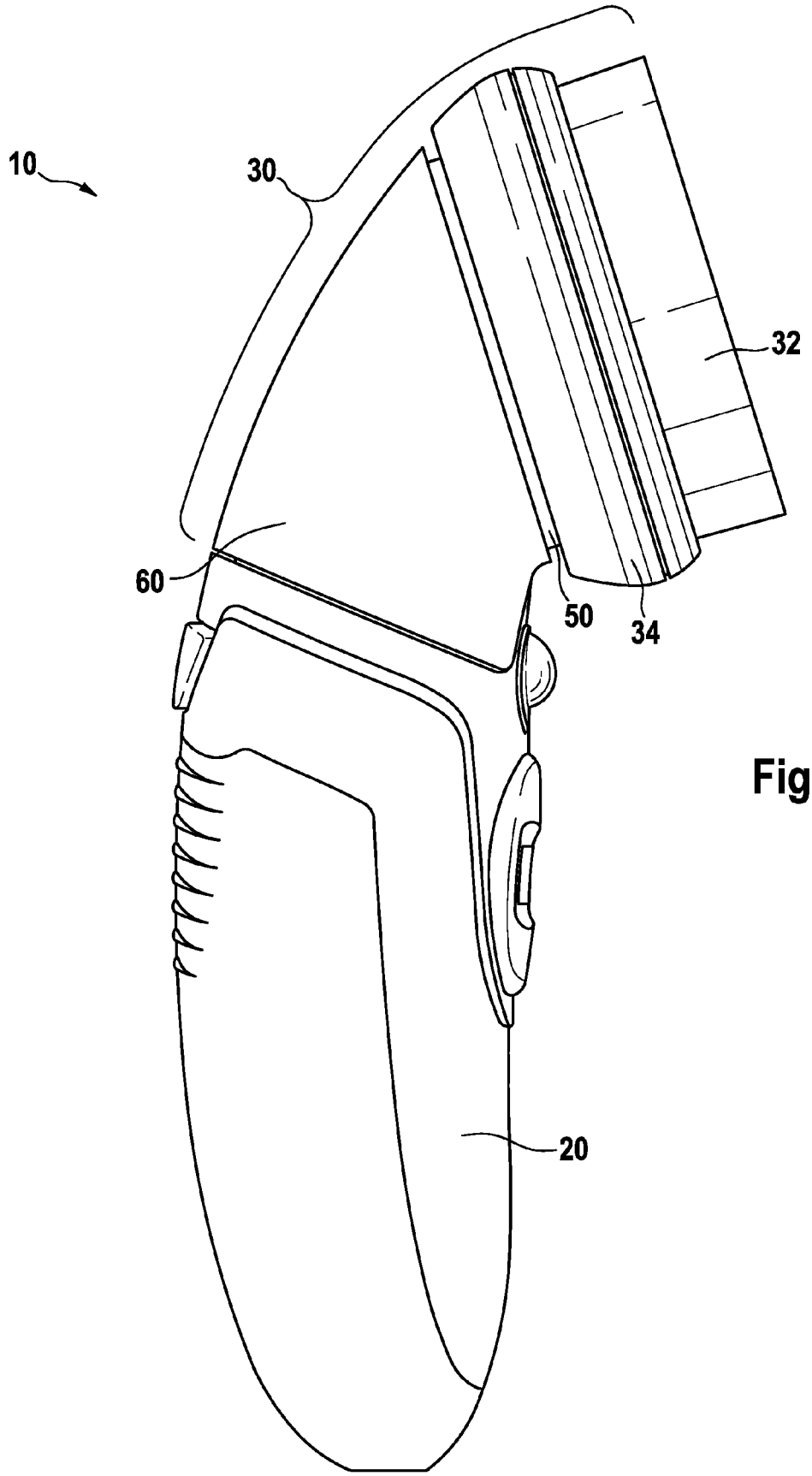
FIG. 2 shows a side view of the skin treatment device of FIG. 1

FIG. 2 shows the same device 20 in a side view. From the side view it is clear that the main axis of the drive unit and the rotational axis of the brush 32 are tilted towards each other. An angle of of about 110° has been found useful. Angles in the range of 90° to 135° and 100° to 120° have generally been found useful for convenient and effective handling. In this side view it can be readily seen, that the attachment 30 comprises a gear box 60, onto which the brush 32 with the brush chassis 34 is mounted. The gear box 60 is connected to the brush chassis 34 via a rotary support element 50, which is only visible in this view as a ring like structure connection brush chassis 34 to gear box 60.

Figure 3:
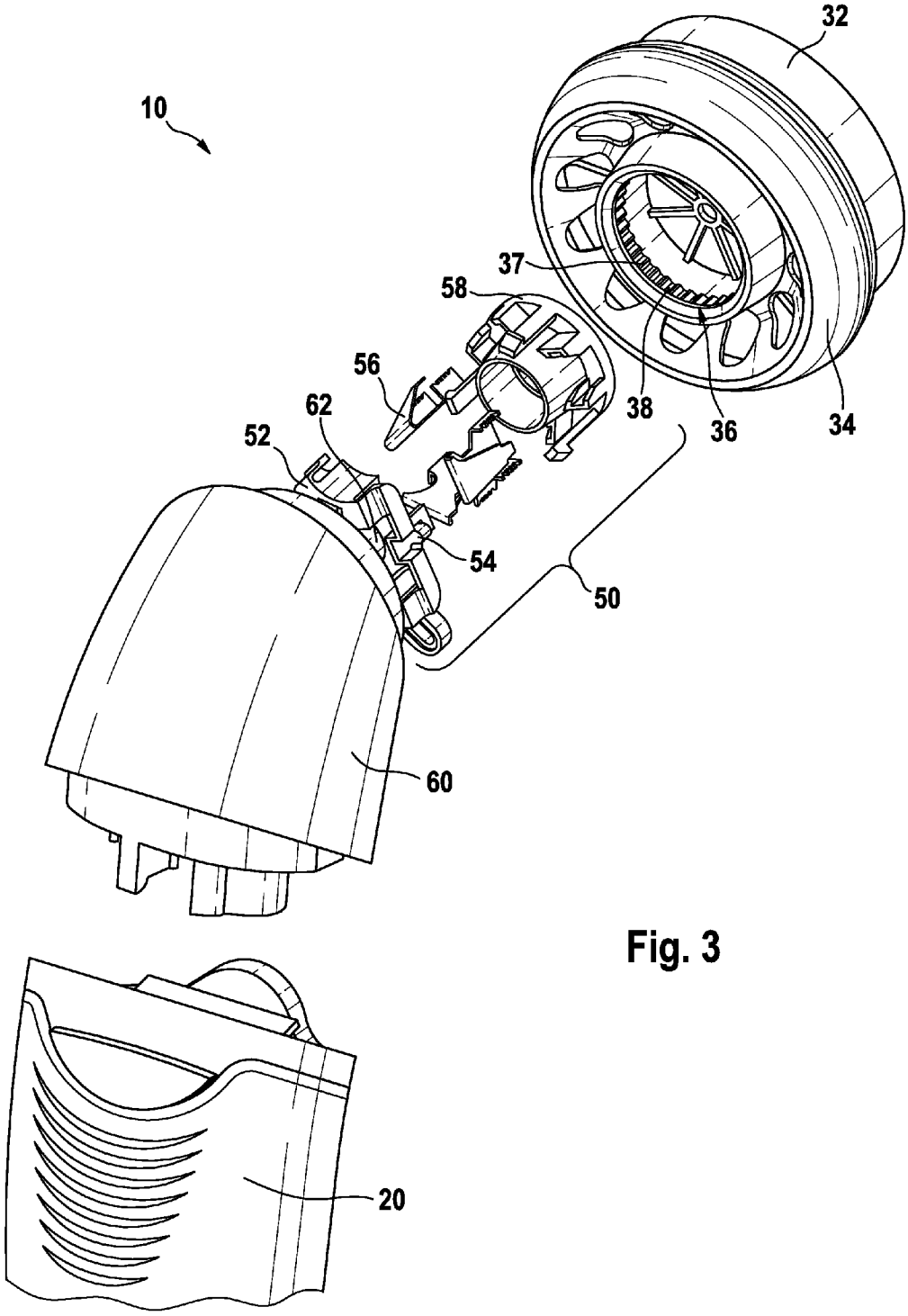
FIG. 3 shows an exploded perspective view of the skin treatment device

FIG. 3 shows an exploded perspective view of some key elements of the device 10. The drive unit 20 is shown while being separated from the gear box 60. The gear box provides a central rotational drive shaft 62.

On this central drive shaft 62 the rotary support element 50 is mounted. It comprises several sub-elements. Firstly, it comprises rotary plate 52, which is mounted onto shaft 62. Rotary plate 52 comprises protrusions in the form of latches 54. Further spring elements 56 are mounted onto the rotary plate 52. These spring elements 56 can excerpt a pressure onto and bias the latches 54. The direction of the pressure is outward from the drive shaft 62. Support plate 58 is mounted onto rotary plate 52. The support plate 58 and the rotary plate 52 have a form fit in several portions, at which they touch. The support plate 58 serves as a support for the brush chassis 54.

The exploded view also shows further details of the body oriented portions of attachment 30. As shown before the brush element 32 is supported by brush chassis 34. The brush chassis 34 comprises a toothed ring 36. The toothed ring comprises teeth 37 and triangular recesses 38 between each set of two neighboring teeth. (Only a single representative tooth 37 and neighboring recess 38 is indicated in the Figure.) The toothed ring snugly fits onto the rotary support element. Details of the engaged relations of the two elements will become apparent from FIG. 4.

Figure 4:
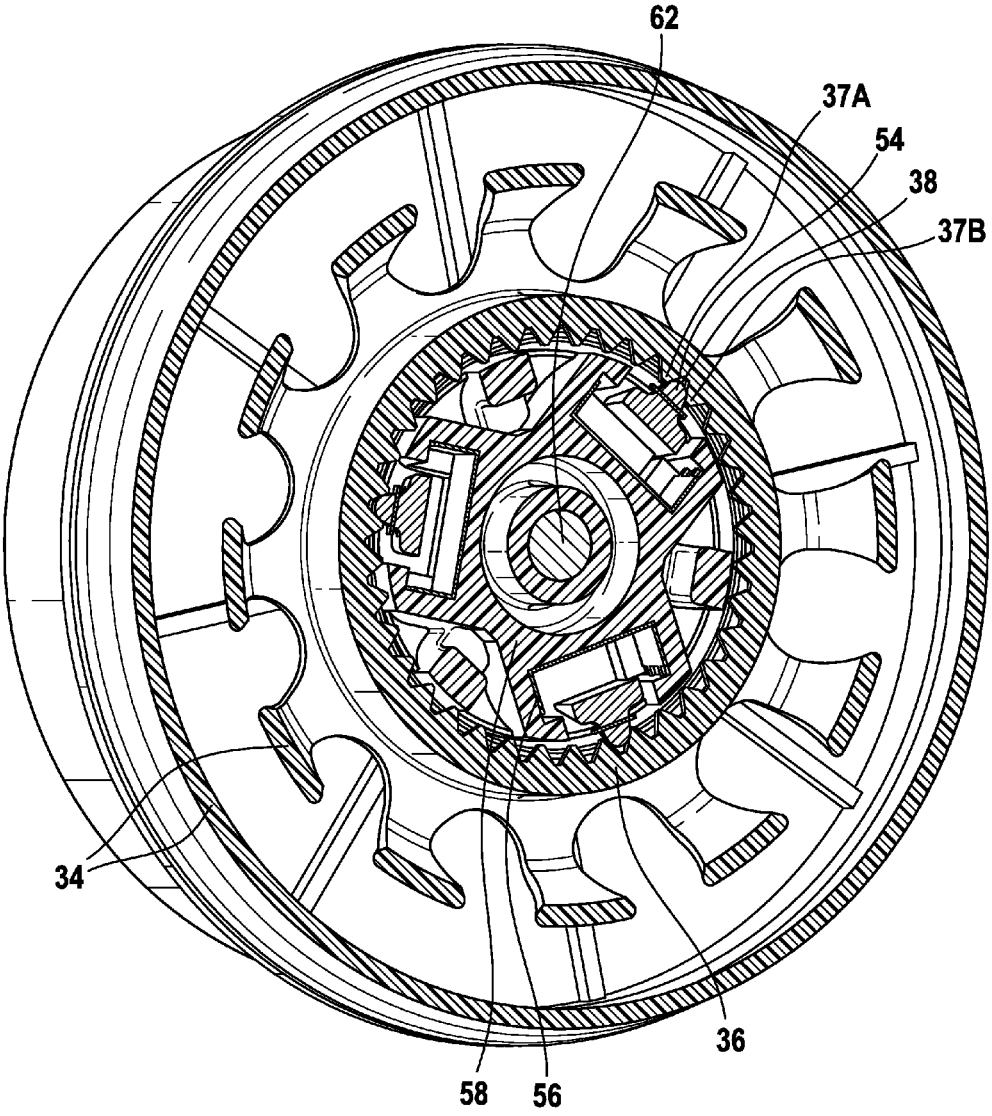
FIG. 4 shows a partially cutaway rear view onto an attachment according to the present invention

FIG. 4 provides a partially cut enlarged view of the brush chassis 34 and elements of the rotary support element 50. The drive shaft 62 is surrounded by portions of the support plate 58. The rotating plate 52 is brought into contact with the support plate 58, such that latches 54 can be biased by spring elements 56 which are mounted onto the support plate 58. The latches 54 are provided with noses facing away from drive axis 62. The latches 54 with their respective noses engage with triangular recesses 38 of the toothed ring 36 of the chassis 34. Representative tooth 37A and tooth 37B defining recess 38 are shown.

It is obvious from the Figure, that an engagement in many selectable positions of the latches 54 and the recesses is possible. Hence the chassis 34 can be engaged with the rotary support element 50 in various angular positions. In accordance with the present invention the angular offset of these positions is no more than 45°, preferably no more than 30° or 20° or 10° or 5°. Hence, a brush can be attached to the drive unit in many adjacent positions, such that the attachment is intuitive and convenient.

Figure 5:
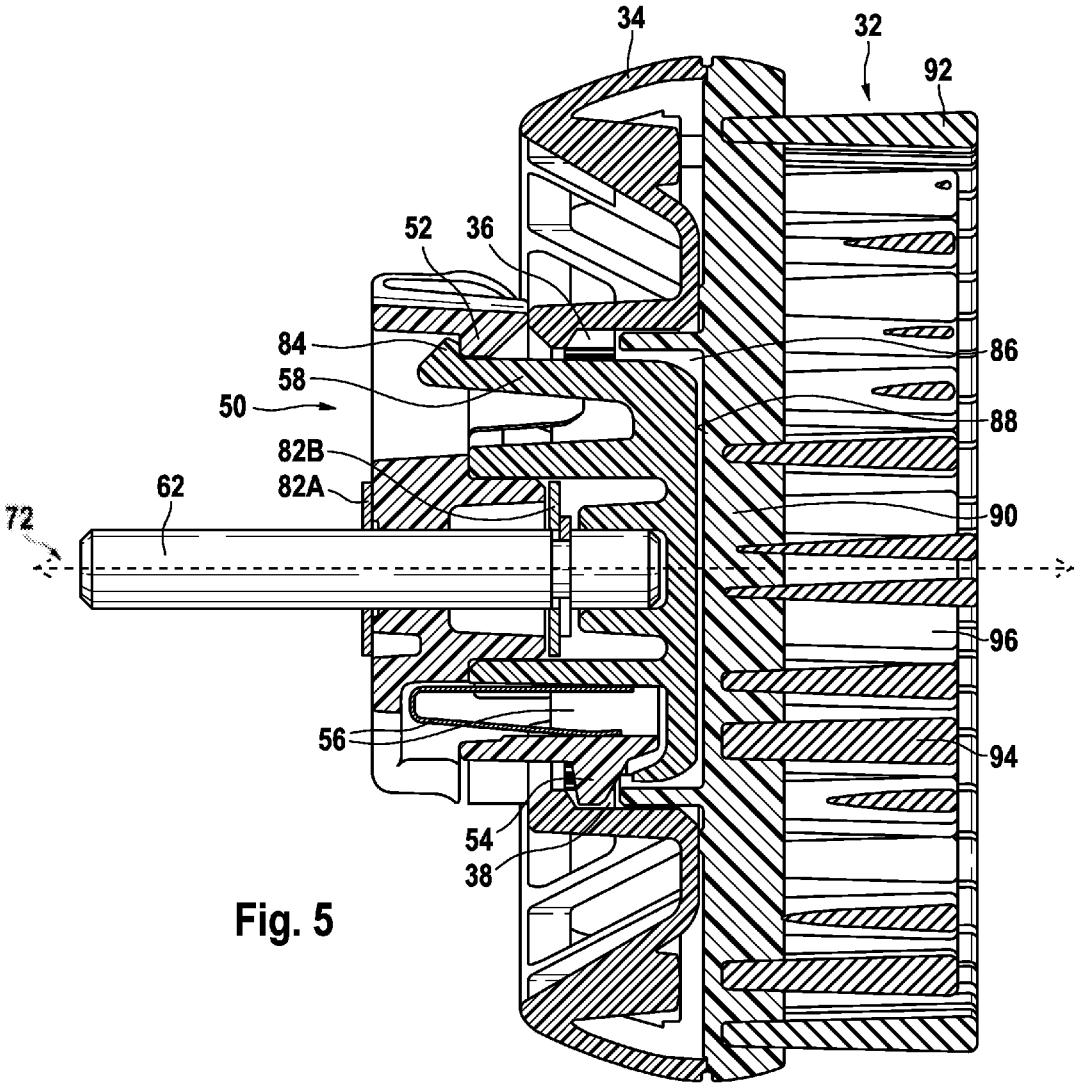
FIG. 5 shows a partially cut away side view of a portion of the device

FIG. 5 shows a partially cut side view of the attachment 30 and the rotary support element 50. From this side view the interaction between the rotary support element 50 and the attachment can be better understood. The rotary support element 50 is supported by the central support axis 72. The axis is received by bearings 82, which can also be combined with or serve as clamps to fix the position of the axis 72 relative to the rotary support element 50. The main components of the rotary support element 50 are the rotary plate 52 and the support plate 58. These two fit snugly together. The rotary plate 52 is connected to latches 54. These latches 54 can also be integrally formed with the rotary support plate 52. The latches 54 are spring loaded by spring elements 56, which are placed in an appropriate cavity between the rotary plate 52 and the support plate 58. The rotary plate 52 and the support plate 58 can be shaped to be suitable for a form fitting connection, which can be secured by certain connectors 84, which can for example, take the form of latches, noses or hooks. The support plate 58 comprises supporting surface 86. This supporting surface 86 can support the skin treatment implement. The skin treatment implement 32 comprises a receiving cavity 88 for receiving the support surface 86 of the support plate 58. The receiving cavity can be formed to be essentially form fitting, but to allow for freedom of rotation about the central support axis 72.

Hence, when a high tangential force is used the fit between chassis 34 and rotary support element 50 can be maintained. However, the disengagement position is assumed as the spring loaded latches disengage from their respective recesses. They can engage with one of the neighboring recesses 38, once the applied tangential force lessens and becomes insufficient for forcing the latches 54 out of the recesses.

This cross-section also provides some details of a useful skin treatment implement 32. Such a skin treatment element can comprise a base plate, for holding a variety of bristles. The base plate 90 can be integrally formed with the receiving cavity 88. The base plate may comprise outer bristles, which form an outer circumferential row around further bristles. the outer bristles can be longer than the inner bristles. Alternatively or additionally an outer rim can be formed. The base 90 will typically support a number of inner bristles 94. All or some of the inner bristles 94 can be shorter than the outer bristles 92. Alternatively or additionally, ligaments 96 can be provided.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A skin treatment device comprising:

(a) drive unit comprising an output element and a rotary support element rotating about an axis of rotation, the rotary support element comprising protrusions and spring elements, the protrusions facing away from the axis of rotation, and the spring elements biasing the protrusions away from the axis of rotation, and (b) an attachment comprising a skin treatment element and a chassis for the skin treatment element, the chassis comprising a multitude of recesses to cooperate with the protrusions of the rotary support element of the drive unit, wherein the chassis is supported by the rotary support element and wherein the protrusions is brought into an engagement position with the recesses, while the chassis is supported by the rotary support element, and the protrusions is brought into a disengagement position with the recesses in reaction to outer forces above a pre-defined threshold, wherein the outer forces are tangential forces relative to the axis of rotation, while the chassis is supported and held in position by the rotary support element, wherein the chassis moves freely about the axis of rotation in the disengagement position; and wherein said multitude of recesses has a shape for receiving said protrusions.

2. A skin treatment device according to claim 1, wherein the recesses of the chassis are facing towards said axis of rotation of the rotary support element.

3. A skin treatment device according to claim 1, wherein the chassis comprises a toothed ring.

4. A skin treatment device according to claim 1, wherein the recesses are provided in the form of triangular recesses.

5. A skin treatment device according to claim 1, wherein the protrusions are provided in the form of latches.

* * * * *